United States Patent [19]

Kawamoto et al.

[11] 3,943,309

[45] Mar. 9, 1976

[54] LOCK MECHANISM

[75] Inventors: Takao Kawamoto, Odawara; Nobuyoshi Mizuno, Isehara; Akira Ota, Hiratsuka, all of Japan

[73] Assignee: NCR Corporation, Dayton, Ohio

[22] Filed: Feb. 27, 1975

[21] Appl. No.: 553,846

[30] Foreign Application Priority Data

Mar. 29, 1974 Japan .....49-35499

[52] U.S. Cl. ..... 200/44; 70/337

[51] Int. Cl.[2] ..... E05B 35/08

[58] Field of Search .. 200/44, 42 R; 70/337, 364 A, 70/378, 379 R, 381

[56] References Cited

UNITED STATES PATENTS 2,667,785 2/1954 Opocensky ..... 70/337

*Primary Examiner*—Herman T. Hohauser

*Attorney, Agent, or Firm*—J. T. Cavender; Wilbert Hawk, Jr.; George J. Muckenthaler

[57] ABSTRACT

A locking mechanism of the cylinder type for a business machine wherein four different keys can be accommodated in a single lock to perform various functions or modes of operation. The mechanism includes ring members and locking pins operably associated with the cylinder and with the lock body either to permit or to restrict rotational movement thereof with respect to the ring members. Rotation of a key in the cylinder to a predetermined limit sets up a switching arrangement to provide a signal for each mode of operation desired to be accomplished.

15 Claims, 17 Drawing Figures

FIG. 8
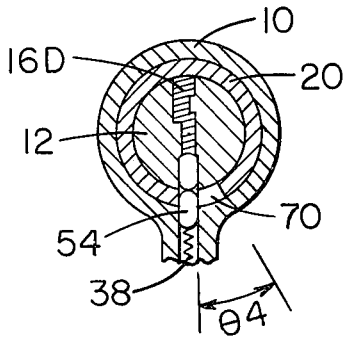
FIG. 9
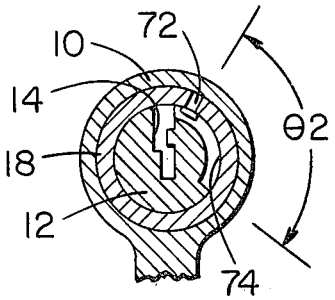
FIG. 10
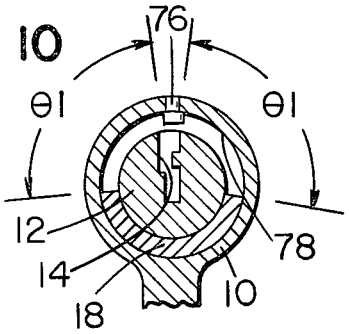
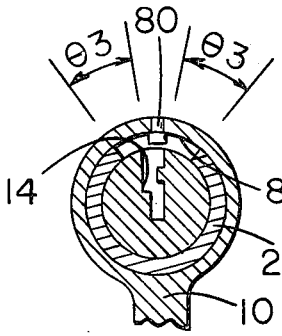
FIG. 11
FIG. 12
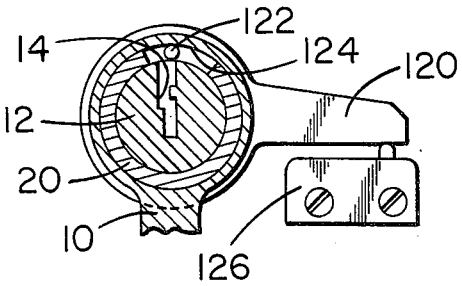
FIG. 13
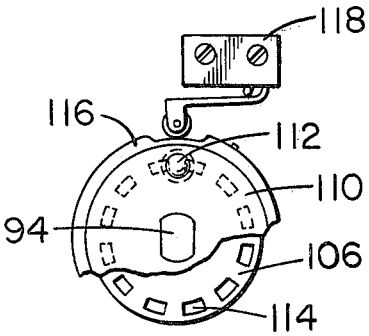

FIG. 14
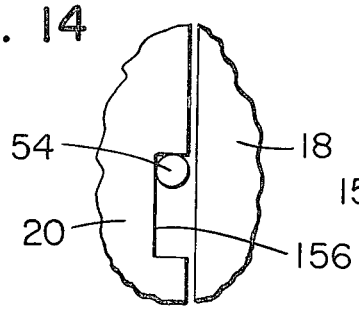
FIG. 15
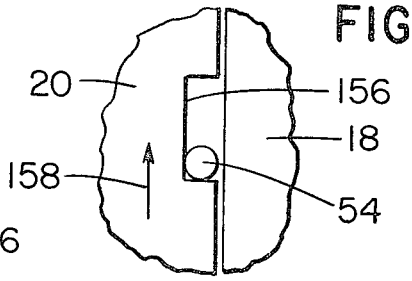
FIG. 16
| KEY \ MODE | | REG | READ | RESET | PROG | CALC |
|---|---|---|---|---|---|---|
| 1 | REG | YES | NO | NO | NO | NO |
| 2 | READ | YES | YES | NO | NO | NO |
| 3 | RESET | YES | YES | YES | NO | NO |
| 4 | PROG | NO | NO | NO | YES | NO |
FIG. 17
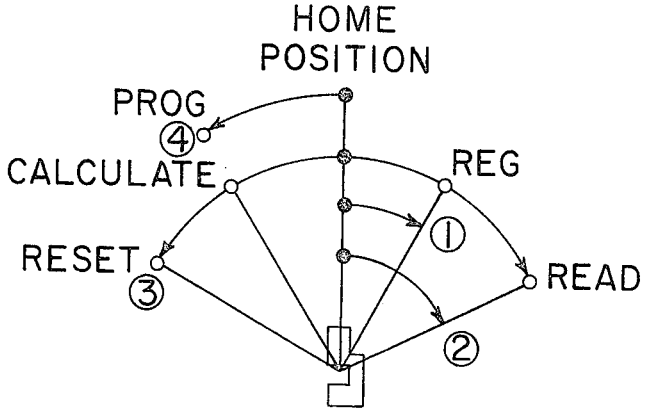

LOCK MECHANISM

BACKGROUND OF THE INVENTION

In lock and locking mechanisms, there has been the use of one or of two keys relating to the lock to program or set the mechanism to one of two positions for a change in operating mode. For example, a lock may be constructed to receive a key for unlocking a device or machine so that operation thereof is permissible and the same lock may be constructed to receive a second key for a different operation which may be in the form of a checking nature or to reset the device or machine. Normally, the structure for changing or for interrupting a key operation requires complicated and complex mechanism and there is a susceptibility of interference between the operating mode and the check or reset mode which may cause errors in the operation. Additionally, it is desirable that setting of a lock mechanism be an initiation point for a further switching operation and this feature has been omitted in prior machines of the type described.

Such devices or machines may be designed to provide a plurality of functions with a single unit. For example, a cash register is operable to perform several functions as registration, correction of error registration, registration of article returned, checking, settling account, settling total account and the like. While the machine operator may be required to perform only one or two of these functions, the machine should be controlled so that it can be operated by other personnel for one or more preselected functions. When a cash register is used in a department store, the register need be controlled in a manner that it can be operated by sales persons for registration; by floor supervisors for registration, correction of registration, and registration of article returned; by accounting personnel for checking and various like functions; and by a manager for any or all of these operations.

In this respect, a conventional cash register may be provided with a function selector switch connected to a plurality of locks and each operator is permitted to use only one or more keys for his purposes. The use of only one or two keys is a disadvantage as it necessitates the provision of two or four separate locks for a single machine, or in the above-mentioned situation, four different operators of the machine utilize four different types of keys. The provision of more than two separate locks for a single machine would complicate the construction thereof and would not be preferred. Another disadvantage of a conventional lock is that it provides no mechanism for reliably preventing the key from being rotated inadvertently and wherein erroneous operations would occur.

SUMMARY OF THE INVENTION

The present invention relates to locking mechanisms and more particularly to a lock of the cylinder type for receiving a plurality of keys to perform various functions or modes of operation. The use of the locking mechanism is applicable to business machines such as cash registers, accounting machines, calculating machines and the like, however the structure and function can be expanded to other devices which may require a lock designed to receive a plurality of keys and utilizing a changeover type switching arrangement for overall control in addition to the selection of a variety of different modes of operation.

In the particular construction, four kinds of keys have different profiles of angular slots to provide the movements necessary to change to each mode of operation. The lock and associated changeover type switching arrangement enables the following functions to be performed:

1. Starting or stopping an operation of various types of business machines.
2. Common use in on-and-off operation of a switching cycle at the same time that a change in operating mode is required.
3. The assuring of one or more changes in mode of operation.
4. The restriction of operation, at the time a change in mode of operation is required, by the use of different kinds of keys to sort out a desired mode function.
5. By utilizing electromagnets, the lock construction may be compact in size, but assure normal operation and non-interference of parts or operation.
6. The different kinds of keys have different angular slots and provide a larger number of combination of modes.
7. The different keys provide for a selection for each change in modes.

The four kinds of keys are applied to a single lock as a register key, a read key, a reset key, or a program key. The lock mechanism comprises a lock main body, a cylinder received in the lock body and having a key hole defined therethrough, at least two rings each being rotatably arranged between the main body and the cylinder, a plurality of locking pins so arranged as to cause the rings to engage either with the main body or with the cylinder as determined by the key utilized, means for limiting the angular range of each ring rotatable relative to the main lock body or with the cylinder, and switch means connected to said cylinder for signaling the mode selected. A rotary disk is connected to the cylinder and includes a plurality of notches formed in the circumference thereof and a stopper plate is movably arranged for engaging one of the notches to thereby stop the rotary disk, there being electromagnets fro driving the stopper plate in engaging and disengaging manner with the disk.

In view of the above discussion, the principal object of the present invention is to provide an improved lock mechanism capable of selecting various modes of operation.

Another object of the present invention is to provide a lock which permits the use of four or more different types of keys for the various modes of operation.

An additional object of the present invention is to provide in a business machine a plurality of operations and means for selecting one or more of such operations by a lock mechanism capable of receiving and responding to a plurality of keys controlled by different operators.

A further object of the present invention is to provide a lock equipped with a mechanism for permitting the selection of one function while prohibiting the selection of other functions.

Additional advantages and features of the present invention will become apparent and fully understood from a reading of the following description taken together with the annexed drawing, in which:

FIG. 8 is a sectional view taken on the plane 8—8 of FIG. 7;

FIG. 9 is a sectional veiw taken on the plane 9—9 of FIG. 3;

FIG. 10 is a sectional view taken on the plane 10—10 of FIG. 3;

FIG. 11 is a sectional view taken on the plane 11—11 of FIG. 3;

FIG. 12 is a sectional view taken on the plane 12—12 of FIG. 3;

FIG. 13 is an elevational view taken on the plane 13—13 of FIG. 2;

FIG. 14 is a detailed view of a control member in one position;

FIG. 15 is a detailed view of the control member in another position;

FIG. 16 is a chart of the key-mode relationship; and

FIG. 17 is a diagram showing the angular positions of the various modes.

Figure 1:
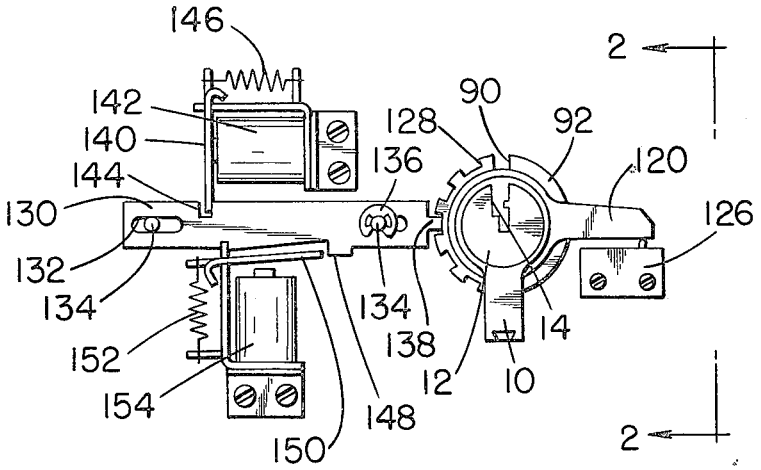
FIG. 1 is a front elevational view of the lock mechanism of the present invention.
Figure 2:
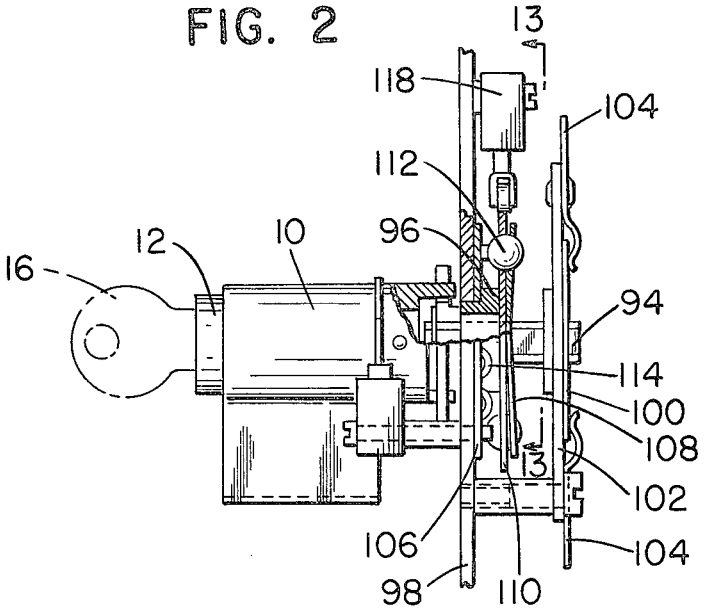
FIG. 2 is a side elevational view of the lock mechanism shown in FIG. 1, as viewed along the plane 2—2.
Figure 3:
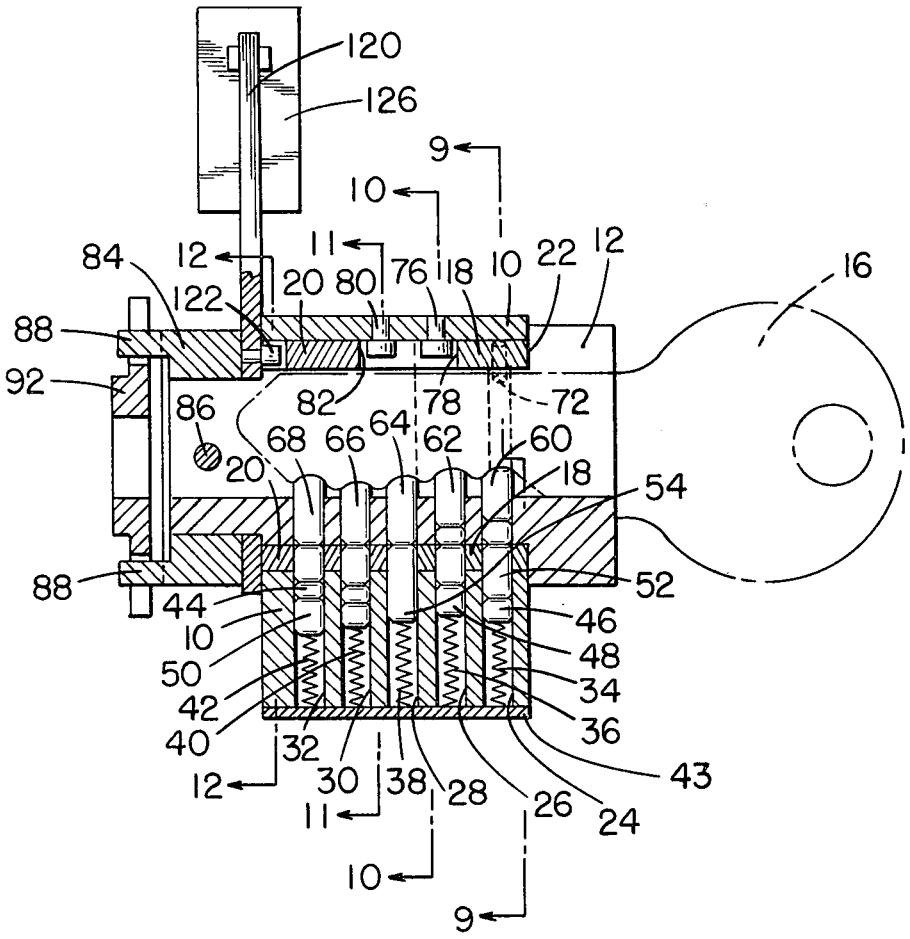
FIG. 3 is an enlarged sectional view of the body portion of the lock mechanism.
Figure 4:
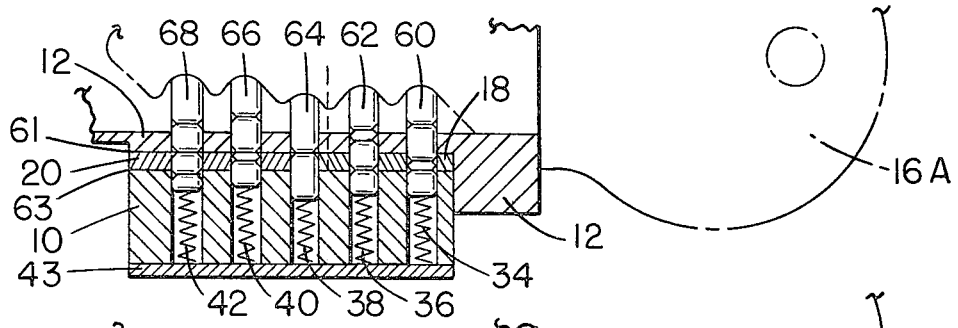
FIG. 4 is a view of a key in one position for a mode of operation.
Figure 5:
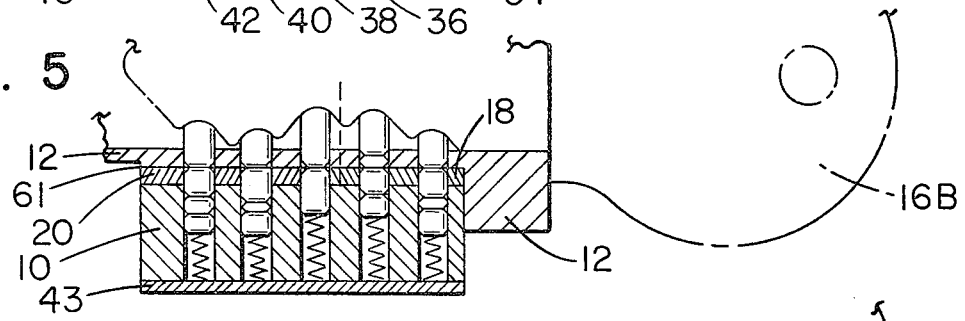
FIG. 5 is a view of another key in position for a different mode of operation.
Figure 6:
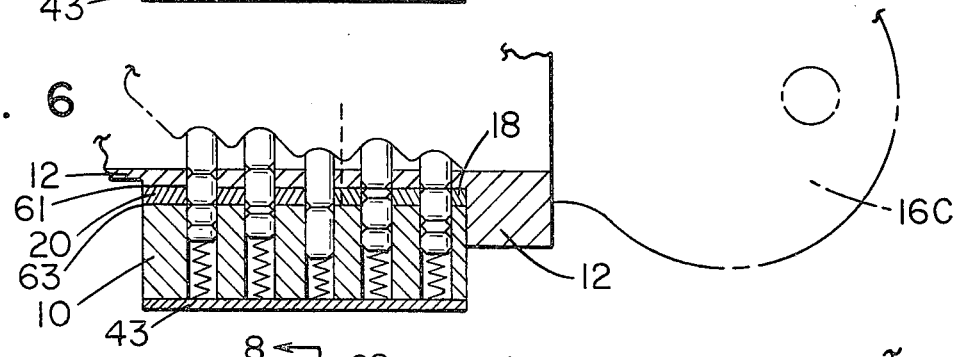
FIG. 6 is a view of a third key in position for a third mode of operation.
Figure 7:
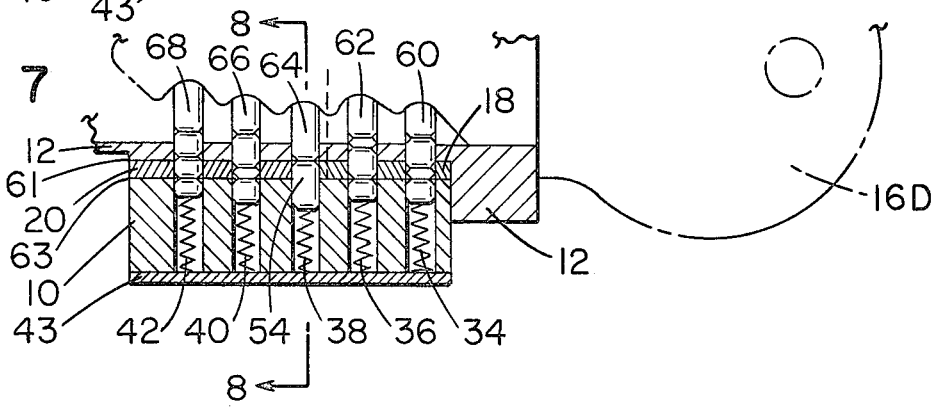
FIG. 7 is a view of a fourth key in position for a fourth mode of operation.

As illustrated in FIGS. 1 and 2, the lock mechanism of the present invention includes a main body portion 10 which rotatably receives a cylinder 12 therein, the cylinder having a slot 14 for inserting a key 16. Within the main body portion 10, two rings 18 and 20 are rotatably arranged around the outer circumference of the cylinder 12, as seen in FIG. 3, the rings being of a band type and extending axially along a cutout 22 in the cylinder and adjacent each other for purposes to be described. The body portion 10 includes in the bottom or lower section thereof a plurality of apertures such as passageways 24, 26, 28, 30, and 32 which extend through the enlargement of portion 10, the rings 18 and 20, and through the cylinder 12 to receive a plurality of locking pins, some of which are of the same length and others of different lengths, all of the pins in each aperture or passageway being biased in an upward direction by appropriate sizes and lengths of springs 34, 36, 38, 40 and 42. The several springs are retained in the respective passageways by appropriate cover means 43. The locking pins assume six different lengths as shown, there being three of the shortest pins 44, three pins 46, one pin 48, four of the pins 50, three pins 52, and four of the longest pins 54. Suffice it to say that this combination of pin lengths could readily be varied to accommodate the desired lengths for the different keys. For purposes of this application the locking pins will be separated into the five groups as shown in FIG. 3, the right pin group 60, group 62, the middle group 64, group 66, and the left pin group 68. Depending upon the configuration of the key selected to be used in the lock mechanism, the locking pins non-rotatably engage the cylinder 12 with the rings 18 and 20 or rotatably disengage the cylinder 12 from the rings, and non-rotatably engage the rings 18 and 20 with the body portion 10 or rotatably disengage the rings from the body portion 10. This engagement and disengagement action will be further shown and described.

In accordance with the present invention and with a lock mechanism having the above-described general configuration, four different types of keys can be used as seen from the variations in the keys shown in FIGS. 4–7. The four keys have different contours or profiles which operate with the spring loaded pins in determining or selecting the operation of the cylinder 12 in relation to the rings 18 and 20. When the key 16A is inserted into the key slot 14, FIG. 1, the separating surfaces of the locking pins of groups 64, 66, and 68 are in alignment with the sliding surface 61 between the cylinder 12 and the ring 20, and the separating surfaces of the locking pin groups 60 and 62 are in alignment with the sliding surface 63 between the ring 18 and the body portion 10, so that the cylinder 12 and the ring 18 rotate together as a unit, whereas the ring 20 is held stationary in the position locked by the body portion 10. In other words, the inner circumferential surface of the ring 20 and the outer circumferential surface of the ring 18 serve as sliding surfaces in the relationship of the several parts.

When the key 16B is inserted into the slot 14, the separating surfaces of all the locking pin groups 60, 62, 64, 66 and 68 are in alignment with the outer circumferential surface of the cylinder 12, so that the rings 18 and 20 engage the body portion 10, and only the cylinder 12 is rotatable to the effect that the outer circumferential surface of the cylinder 12 serves as the sliding surface 61 in relation to rings 18 and 20.

Upon insertion of the key 16C, the ring 20 engages the cylinder 12, while the ring 18 engages the body portion 10. Under these conditions, the outer circumferential surface of the ring 20 and the inner circumferential surface of the ring 18 serve as the sliding surfaces 63 and 61, respectively.

When the fourth key 16D is inserted, the separting surfaces of the locking pin groups 60, 62, 66, and 68 are in alignment with the outer circumferential surfaces of the rings 18 and 20. In this position, the lower pin of pin group 64 extends through both the ring 20 and the body portion 10. Since the ring 20 includes a slot 70, FIG. 8, serving as a passageway for the spring 38 loaded locking pin 54 of pin group 64 (see also FIG. 3), the ring 20 can be rotated relative to the body portion 10 by the arcuate length of the slot 70 and indicated by the angle $\theta 4$, FIG. 8. Therefore, the rings 18 and 20 are rotatable together with the cylinder 12, and the outer circumferential surfaces of the rings 18 and 20 serve as the sliding surface 63, the inner surface of ring 20 being along the sliding surface 61.

It should now be noted that, by inserting the four different types of keys 16A, 16B, 16C and 16D into the slot 14, four different kinds of sliding surfaces are established between the cylinder 12 and the body portion 10. In the event a key other than those mentioned above is used, the respective locking pins will lock the cylinder 12, the rings 18 and 20, and the body portion 10 together to thereby prevent the cylinder 12 from being rotated.

The lock mechanism according to the present invention includes means for limiting the rotation of the cylinder 12 relative to the ring 18 and also includes means for limiting the rotation of rings 18 and 20 relative to the body portion 10. As seen from FIGS. 3 and 9, a stop pin 72 is fixed to the ring 18 with a head portion of the stop pin 72 projecting inside the ring 18 to ride in a groove 74 defined in the circumferential surface of the cylinder 12, FIG. 9. The position and length of the groove 74 are selected to permit rotation of the cylinder 12 in a counter-clockwise direction through a specified angle $\theta 2$ as shown.

The main body portion 10 carries a stop pin 76, FIGS. 3 and 10, projecting into a groove 78 defined in the circumferential surface of ring 18, and another stop pin 80, FIGS. 3 and 11, projects into a groove 82 provided in the circumferential surface of ring 20. The groove 78 is cut so that the ring 18 can be rotated clockwise through an angle $\theta 1$ as well as counter clockwise through an equal angle, while the groove 82 is cut to permit the ring 20 to be rotated clockwise through an angle $\theta 3$ as well as counter clockwise through an equal angle. The lock pin 54 and groove 70, FIG. 8, also serve as means for limiting the rotation of ring 20 relative to the main lock portion 10, wherein length of groove 70 is selected to permit the ring 20 to be rotated clockwise through the angle $\theta 4$, as shown. The above-mentioned angles are selected to satisfy the following relationship: that the angle $\theta 1$ for pin 76, FIG. 10, is equal to or greater than the angle $\theta 2$ for pin 72, FIG. 9, which is equal to or greater than the angle $\theta 3$ for pin 80, FIG. 11, which is equal to or greater than the angle $\theta 4$ for pin 54, FIG. 8. In regard to the cylinder 12 and the ring 20, no pin and groove arrangement is provided therebetween so the cylinder 12 and the ring 20 are free to rotate relative to each other.

The following table illustrates the relationship of rotation of the four keys 16A, 16B, 16C, and 16D in the main body portion 10.

| Type of Key | Rotating Member | Stationary Member | Rotation angle of rotating member relative to stationary member | Rotational Angle of Cylinder |
|---|---|---|---|---|
| 16A | Cyl. 12 ⟷ | Ring 20 | Freely rotatable | Clockwise through Θ1 and counter clockwise through Θ1 |
| | Ring 18 ⟷ | Body 10 | Clockwise through Θ1 and counter clockwise through Θ1 | |
| 16B | Cyl. 12 ⟷ | Ring 18 | Counter clockwise through Θ2 | Counter clockwise through Θ2 |
| | ↘ | Ring 20 | Freely rotatable | |
| 16C | Cyl. 12 ⟷ | Ring 18 | Counter clockwise through Θ2 | Counter clockwise through Θ3 |
| | Ring 20 ⟷ | Body 10 | Clockwise through Θ3 and counter clockwise through Θ3 | |
| 16D | Ring 18 ⟷ | Body 10 | Clockwise through Θ1 and counter clockwise through Θ1 | Clockwise through Θ4 |
| | Ring 20 ⟷ | Body 10 | Clockwise through Θ4 | |

It is noted that when key 16D is used, the rotational angle of ring 20 relative to the body portion 10 is limited by the lock pin 54, FIG. 8. The rotational direction (clockwise and/or counter clockwise) is taken as viewed in FIGS. 8–11.

Referring back to FIG. 3, a connecting ring 84 is fixed to the rear portion of the cylinder 12 by means of a pin 86, the ring 84 having a plurality of projections 88 formed thereon to engage with grooves 90, FIG. 1, in the outer circumferential portion of a rotary disk 92 for transmitting motion thereto. The disk 92 is fixed on a shaft 94, FIG. 2 which shaft is rotatably supported in a bearing 96 attached to a frame 98, so that rotation of key 16 is transmitted to the shaft 94 by way of the cylinder 12. On the rear end of the shaft 94 is mounted a rotary selector switch plate 100 to be rotatable with the shaft, and opposite the plate 100 is a plate 102 which is fixed to the frame 98 and carries a plurality of contact members 104 arranged in a circular configuration. When the key 16 is rotated, the selector switch plate 100 is likewise rotated to establish an electrical contact with any one of the contact members 104 for pulsing and developing an electrical signal. The contact members 104 are electrically connected in a manner to provide the various functions of the cash register or like machine. One contact member, for example, may be connected for permitting the registration operation of the register, another contact member may be connected for the article returning operation, and a further contact member may be connected for setting the total account. The position and number of the contact members 104 may be suitably selected and dependent upon various factors such as the number of functions of the register having the lock mechanism of the present invention, the type of keys used, the rotational angle of the keys, and like factors.

To insure that a positive contact of the selector switch plate 100 with any one of the contact members 104 is made, and to hold the selector switch plate in a contact position, that is, to stop the rotation of key 16 at precisely predetermined positions, a locating disk 106, FIGS. 2 and 13, is attached to the frame 98, and a leaf spring 108 and a plate 110 for holding steel balls 112 are mounted on the shaft 94. The leaf spring 108 acts to urge the steel ball 112 against the locating disk 106. A plurality of formed projections 114 are spaced on the circumferential portion of the locating disk 106 to permit the steel ball 112 to drop and be retained in the space defined between any two adjacent projections 114 at precise positions when the rotation of shaft 94 and of selector switch plate 100 is to be stopped. Thus the angular position of key 16 is determined by the steel ball 112 when it drops into the space between the projections 114 formed on the locating disk 106. This angular position is maintained until a force is applied to the steel ball 112 by turning the key 16, and the steel ball 112 is pushed outwardly against the resilient force of leaf spring 108.

The outer circumferential portion of ball holding plate 110 is provided with a cam portion 116, FIG. 13, to operate with a microswitch 118 to develop another electrical signal for a desired purpose. As seen in FIGS. 3 and 12, a lever 120 is slidably arranged around the outer circumference of cylinder 12 in a position adjacent the connecting ring 84, and the lever 120 is provided with a pin 122 fixed thereon and which projects into a groove 124 formed in the ring 20 so that the lever 120 can be moved when the ring 20 is rotated until the end portions of the groove 124 engage the pin 122. Adjacent the lever 120 is located a microswitch 126 which detects the movement of ring 20 and develops an electrical signal. The providing of a plurality of microswitches such as 118 and 126 enables the mechanism to develop an increased number of electric signals.

Referring again to FIG. 1, there is illustrated mechanism for preventing the key from being rotated. A plurality of notches 128 are formed in the outer circumferential portion of the rotary disk 92 which disk is rotatable with the cylinder 12. A stopper plate 130 is provided with a pair of slots 132 and is longitudinally and slidably supported by pins 134 which are fixed or secured to the frame (not shown) and extend through the slots, with retainer rings 136 on the pins to prevent disengagement of the plate 130 from the pins 134. The stopper plate 130 has a projection 138 formed on the right-hand end thereof which engages into one of the notches 128 of disk 192. An armature 140, which is swingable upon energization of an electromagnet 142, has one end thereof loosely engaged in a notch 144 in the stopper plate 130, the other end of the armature 140 being urged in one direction by means of a spring 146 which has sufficient force to move the plate 130. When the electromagnet 142 is momentarily energized, the armature 140 is attracted thereby and the projection 138 engages with one of the notches 128. The stopper plate 130 is also provided with a projection 148 on the underside thereof which engages the one end of an armature 150 which is urged by a spring 152 so that the one end of armature 150 is in normal engagement with the projection 148, and after terminating the energization of electromagnet 142, the stopper plate 130 is retained in the position as shown in FIG. 1. The armature 150 is caused to be disengaged from the projection 148 upon energization of an electromagnet 154 and the stopper plate is displaced in a leftward direction under the action of the spring 146 so that projection 138 is disengaged from the notch 128 in disk 92, thereby permitting the cylinder 12 to rotate freely. When the electromagnet 142 is momentarily energized, the stopper plate 130 is moved in a rightward direction to the position shown and thereby prevents the cylinder 12 from being rotated. The electromagnets 142 and 154 are actuated by separately arranged switches (not shown). It is of course to be noted that the positions of notches 128 in disk 92 in relation to the stopper plate 130 are selected so that the notches correspond to the angular position of the selected keys.

Illustrated in FIGS. 14 and 15 is the control pin 54 of pin group 64 which pin is slidable or movable in the direction along a slot 156 in ring 20, as indicated by the arrow 158 in FIG. 15. The pin 54 cooperates with either the outside diameter of cylinder 12 and the inside diameter of ring 20, or with the outside diameter of ring 20 and the inside diameter of body portion 10. In the combinations of sliding movements of the control pins of the various pin groups 60, 62, 64, 66, and 68, the movement of control pin 54 has no relationship with the limitations imposed on the type of keys used, but when the outside diameter of rings 18 and 20, and the insider diameter of body portion 10 contact each other, the control pin 54 moves along the length of slot 156 in ring 20 and prevents further rotational motion.

FIGS. 16 and 17 show, respectively, the key-mode relationship and the angular positions allowable by each of the four keys for the mode selected. As mentioned above, the four keys are designated for register, read, reset and program, and, depending upon the function desired, the key is inserted into the lock at the home position and the lock cylinder 12 is controlled as shown. When key 1 is inserted at the home position and rotated clockwise to the register position, the register mode is set and as seen in FIG. 16, no other function is permissible. Rotation of the cylinder 12 causes the rotor of the changeover switchboard or plate 100 to be rotated by the cam lock 88 at the rear end of the lock and rotation plate to signal for register, read, or reset depending upon the position of the key 1, 2, or 3. When key 4 or the program key is positioned, the rotor goes to calculate position, but the program signal, which is different from the calculate signal, is developed by reason of the fact that ring 20 is being rotated with the cylinder 12 which switches on the microswitch 126 by moving the lever 120 with the pin 122. At the same time that a key is rotated to its mode position, the microswitch 118 is operated by the camming of the retaining plate 110 and power is switched on. For example, at the register mode, when the operator inputs through the keyboard, a mode change cannot be made until the total operation is completed because it is interlocked by operation of the solenoid 142, the lug 138 of control plate 130 engaging in slot 128 of rotation plate or disk 92.

A brief description of a cycle of operation is as follows: A key is inserted into the slot 14 of the cylinder 12 and is rotated to a desired mode position, the switchboard 100 being rotated by the cylinder 12, the cam lock 88, the rotation plate 110 and the shaft 94. Each contact 104 at 30 degree intervals on the stator of the switchboard 100 develops a signal corresponding to a contact point by breaking contact at 9° before the contact point rotation of the rotor of the switchboard. Upon further rotation of the rotor of the switchboard 100, and at 3° before the contact point, the "power on" microswitch is switched on by the cam of the retaining plate 106, and at the 30° position, the steel ball is in place under urgence of the spring 108 of plate 110. To prevent a misoperation by turning the key to another position while the electrical signal is being developed and sent out, operation of the key is prevented by the control plate 130 advancing to one of the slots 128 of rotation plate 92 by an external signal. After there is no need for the external signal sent to the solenoid 142, the control plate 130 returns to the leftward position and the rotation plate 92 is disconnected from the slot 90 and operation of the key again becomes possible. The key is then turned to the home position and the retaining plate 110 is rotated to cause the microswitch 126 to turn power off, the contact points of the switchboard being returned to the home position.

It is thus seen that herein shown and described is an improved lock mechanism wherein four different keys can be used with such mechanism and the rotatable angular ranges of these keys can be varied from each other. When the lock mechanism of the present invention is mounted on or connected to a cash register or the like, the features of the invention, as mentioned immediately hereinabove, permit the setting of the register in the desired operating modes by changing keys, and it is therefore possible to obtain various functions from the register by selecting a desired key from four different types of keys. The lock mechanism is free from troubles due to the provision of means for preventing the key from being rotated unintentionally during operation of the machine. The mechanism enables the accomplishment of the objects and advantages mentioned above, and while only one embodiment of the invention has been disclosed herein, certain variations may occur to those skilled in the art. For example, although two rings are arranged between the body portion and the cylinder, one or more additional rings may be used to increase the number of rotary sliding surfaces defined between the body portion and the cylinder to thereby permit the use of an increased number of keys. It is contemplated that all such variations, not departing from the spirit and scope of the invention hereof, are to be construed in accordance with the following claims.

What is claimed is:

1. A lock mechanism comprising a body portion, a cylinder received in said body portion and having a key slot defined therethrough, at least two rings each being rotatably arranged between said body portion and said cylinder, a plurality of locking pins positioned to cause said rings to engage with said body portion or with said cylinder by reason of a selected key being inserted into said key slot and rotated therein, means for limiting the angular rotation of each ring in relation to said body portion and/or said cylinder, and means connected to said cylinder for developing a signal responsive to rotation of said selected key.

2. The lock mechanism of claim 1 including means connected with said cylinder for enabling selection of only one position of rotation to develop said signal.

3. The locking mechanism of claim 1 including control means operably associated with said rings and with said body portion for limiting rotational motion of one of said rings.

4. The locking mechanism of claim 1 wherein said body portion of said cylinder include juxtaposed surfaces slidable in relation to each other for permitting selected functional positions of operation.

5. The locking mechanism of claim 1 wherein said limiting means includes stop pins secured to said body portion and extending through said rings and into said cylinder.

6. The locking mechanism of claim 1 wherein said plurality of locking pins are spaced to operate with different types of keys inserted into said cylinder.

7. The locking mechanism of claim 1 wherein said connected means includes a disk member secured to said cylinder for developing said signal.

8. The locking mechanism of claim 1 wherein said connected means includes a disk member secured to said cylinder for rotation therewith and contact members urged into selected positions for developing functional signals.

9. Mechanism for permitting selected function operations comprising a body portion, a cylinder rotatable in said body portion and having a key slot therein for receiving any one of a plurality of keys, means rotatably positioned between said body portion and said cylinder, each of said keys being operable to engage said rotatable means with either said body portion or with said cylinder, means for limiting said rotatable means in relation to said body portion or with said cylinder, and means connected with said cylinder for developing signal means for the selected function.

10. The mechanism of claim 9 including means connected with said cylinder for enabling selection of only one position of rotation to develop said signal means.

11. The mechanism of claim 9 including control means operably associated with said rotatable means and with said body portion for limiting rotational motion of said rotatable means.

12. The mechanism of claim 9 wherein said limiting means includes stop members secured to said body portion and extending through said rotatable means into said cylinder.

13. The mechanism of claim 9 wherein said body portion and said cylinder include adjacent surfaces slidable in relation to each other and a plurality of locking members spaced to permit operation with any one of said plurality of keys to select the desired functional operation.

14. The mechanism of claim 9 wherein said connected means includes a disk member secured to said cylinder for developing said signal means.

15. The mechanism of claim 9 wherein said connected means includes a disk member secured to said cylinder for rotation therewith and contact members urged into selected positions for developing said signal means.

* * * * *